US006280223B1

(12) United States Patent
Lin

(10) Patent No.: US 6,280,223 B1
(45) Date of Patent: Aug. 28, 2001

(54) ZERO INSERTION FORCE CONNECTOR SOCKET WITH HELICAL DRIVING MECHANISM

(75) Inventor: Wei-Yao Lin, Tu-Chen (TW)

(73) Assignee: Hon Hai Precision Ind. Co., Ltd., Taipei Hsien (JP)

( * ) Notice: Subject to any disclaimer, the term of this patent is extended or adjusted under 35 U.S.C. 154(b) by 0 days.

(21) Appl. No.: 09/501,333

(22) Filed: Feb. 9, 2000

(51) Int. Cl.[7] ..... H01R 13/62
(52) U.S. Cl. ..... 439/342
(58) Field of Search ..... 439/342, 259–270

(56) References Cited

U.S. PATENT DOCUMENTS 5,057,031 * 10/1991 Sinclair ..... 439/342
5,443,591 * 8/1995 Tsai ..... 439/342
5,454,727 * 10/1995 Hsu ..... 439/263
5,489,218 * 2/1996 McHugh ..... 439/342
5,611,705 * 3/1997 Pfaff ..... 439/342
5,688,140 * 11/1997 McHugh et al. ..... 439/342

* cited by examiner

*Primary Examiner*—Gary F. Paumen
(74) *Attorney, Agent, or Firm*—Wei Te Chung

(57) ABSTRACT

An electrical apparatus in accordance with the present invention for electrically assembling a CPU to a printed circuit board. The CPU includes an array of pin legs. The apparatus comprises a base member securely assembled to the printed circuit board. A cover member is moveably assembled to the base member and defines an array of through holes for extension of the pin legs of the CPU. A driving arrangement is arranged between the base and cover member to drive the cover member to move between first and second positions. The arrangement includes a shaft having a helical section extending therealong, and a follower is moveable along the helical section when the shaft is rotated.

2 Claims, 7 Drawing Sheets

ZERO INSERTION FORCE CONNECTOR SOCKET WITH HELICAL DRIVING MECHANISM

FIELD OF THE INVENTION

The present invention relates to a connector socket, and more particularly to a zero insertion force (ZIF) connector socket with helical driving mechanism for electrically assembling a CPU device to a printed circuit board.

DESCRIPTION OF PRIOR ART

Originally, an upper cover of a socket i is driven by a screwdriver. However, it is unlikely to ask the customer to use an additional tool for mounting of the CPU. In addition to the inconvenience, there is a fear that if the operator tries to use the tool without knowing how, it might cause damage to the socket and/or socket. By the way, the screwdriver is always made from conductive material, i.e. steel. If the screwdriver slips over the socket, it will definitely damage the conductive traces on the printed circuit board. On the other hand, other components may also be damaged or short-circuited.

In order to prevent the above mentioned short-coming, a ZIF sockets are used for assembling a CPU to a printed circuit board. The socket generally comprises a base member including an array of contacting terminals, and a cover member defining an array of through holes corresponding to the contacting terminals. The cover member is movable with respect to the base member. An end of each contacting terminal is soldered into a mounting hole of the PCB. The ZIF socket includes actuation means for selectively displacing the cover member between a first position and a second position. When the cover member is at the first position, pin legs of the CPU are easily inserted into the corresponding holes, i.e. zero-insertion-force. When the actuating means is actuated, the cover member is moved to the second position thereby electrically connecting each pin of the CPU with the corresponding contacting terminal. The CPU is secured in the socket when the cover member is at the second position.

U.S. Pat. No. 5,489,218 discloses a ZIF PGA socket in which the upper cover member is moved by a cam shaft manipulated by a lever arm. U.S. Pat. No. 5,454,727 discloses a similar type of socket which use a cam shaft to drive the upper cover member. Again the cam shaft is driven by a lever linked at an end thereof. U.S. Pat. No. 5,443,591 discloses another socket in which the upper cover member is driven by a cam shaft. Even the sockets are different from each other, their basic design is the same, in short, the longitudinal direction of the cam shaft is perpendicular to the moving direction of the upper cover member.

In fact, the cam shaft shall provide an effective stroke in which the pin leg from the CPU and the contacting terminal of the base member mush be effectively and electrically coupled by the movement of the upper cover member, which is driven by the cam shaft. However, in light of the thickness of the base member, it is unlikely to have a larger cam to provide a longer stroke for the electrical connections between the pin legs and the contact terminals. If the stroke of the upper cover member is not long enough, the connections between the pin legs and the contacting terminals will be adversely effected.

SUMMARY OF THE INVENTION

An objective of this invention is to provide a ZIF connector socket in which a driving shaft is arranged in-line with an upper cover member thereof thereby providing an effective stroke to the upper cover member with respect to the base member.

In order to achieve the objective set forth, an electrical apparatus in accordance with the present invention for electrically assembling a CPU to a printed circuit board. The CPU includes an array of pin legs. The apparatus comprises a base member securely assembled to the printed circuit board. A cover member is moveably assembled to the base member and defines an array of through holes for extension of the pin legs of the CPU. A driving arrangement is arranged between the base and cover member to drive the cover member to move between first and second positions. The arrangement includes a shaft having a helical section extending therealong, and a follower is moveable along the helical section when the shaft is rotated.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENT

Figure 1:
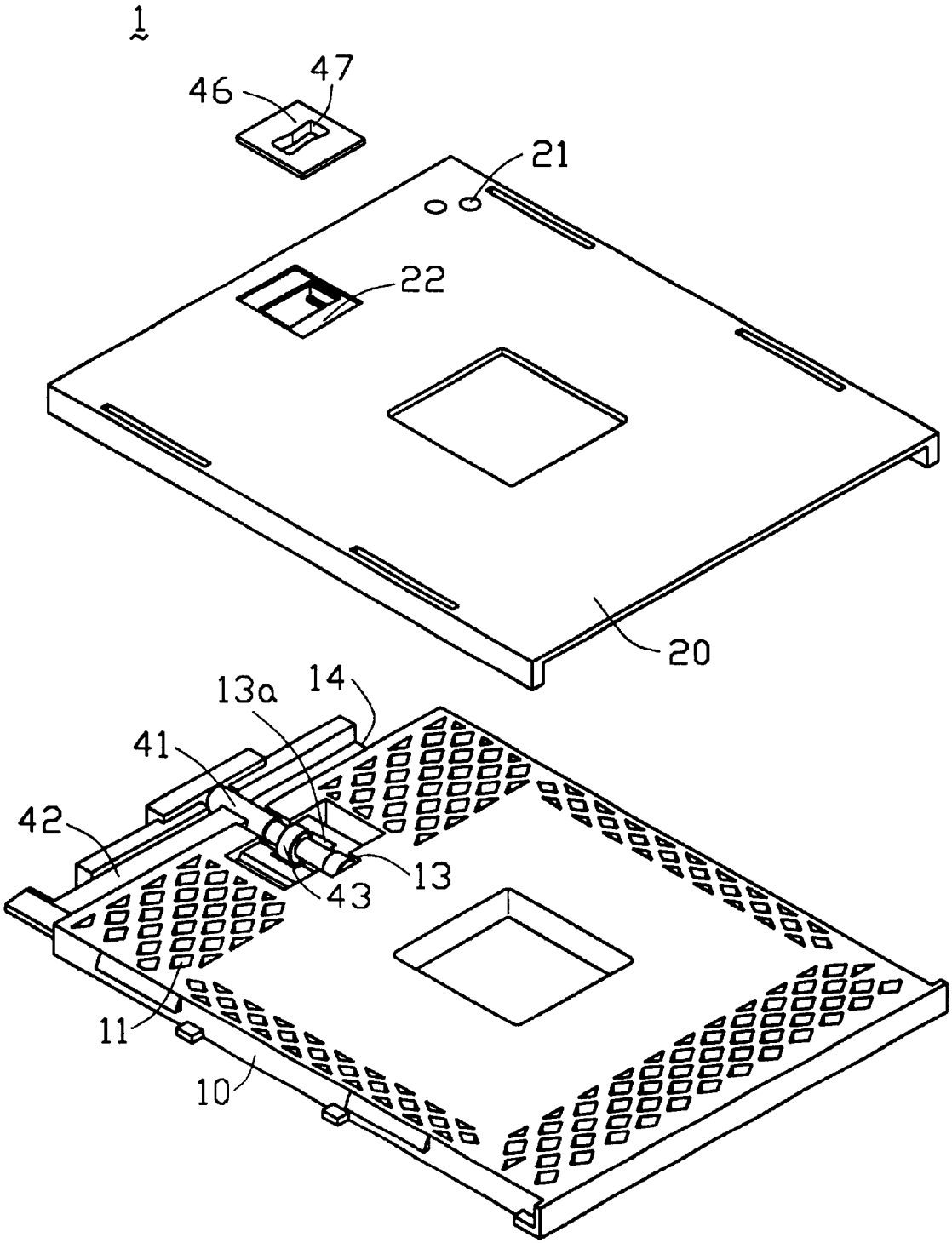
FIG. 1 is a perspective view of an electrical apparatus in according to the present invention.
Figure 2:
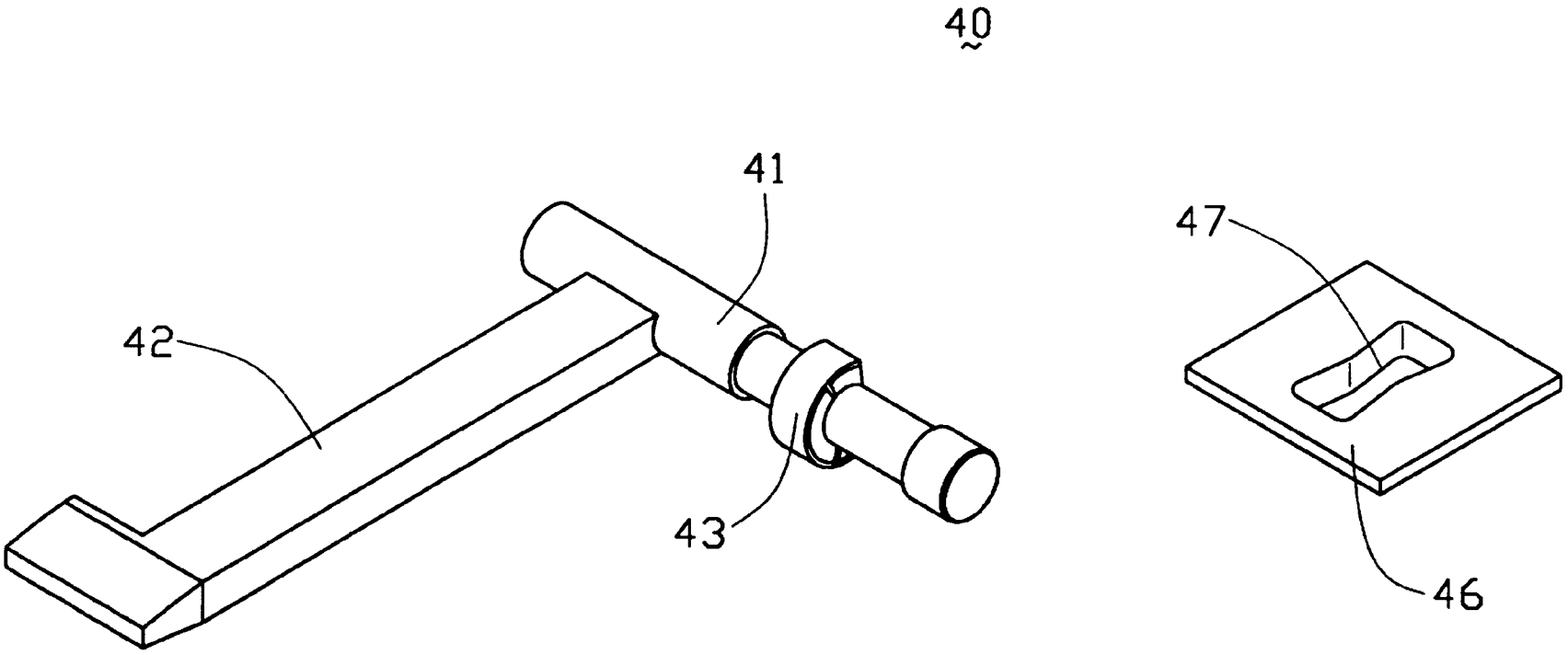
FIG. 2 is a perspective view of a driving arrangement in accordance with the present invention.
Figure 3:
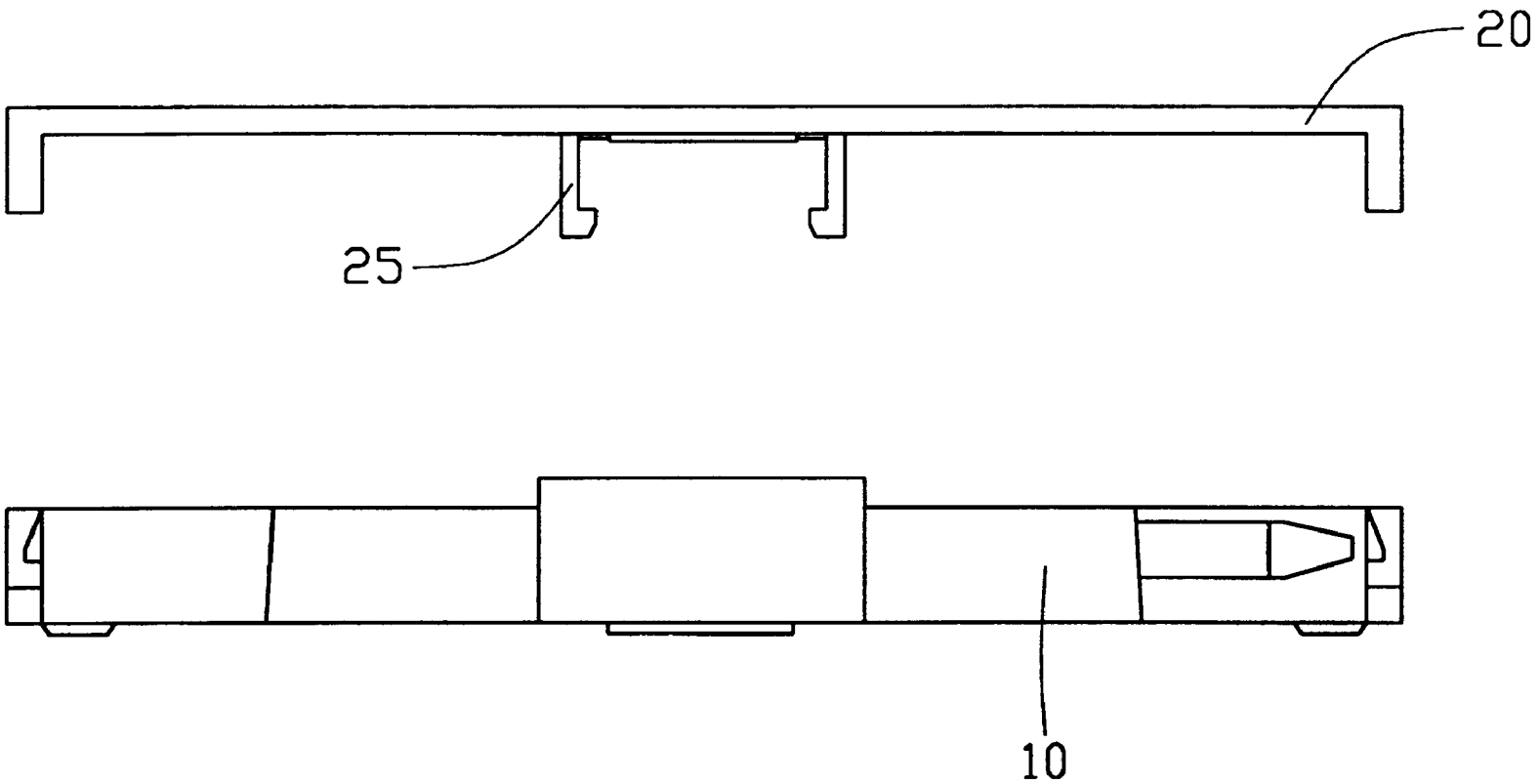
FIG. 3 is an end view of the electrical apparatus of FIG. 1.
Figure 4:
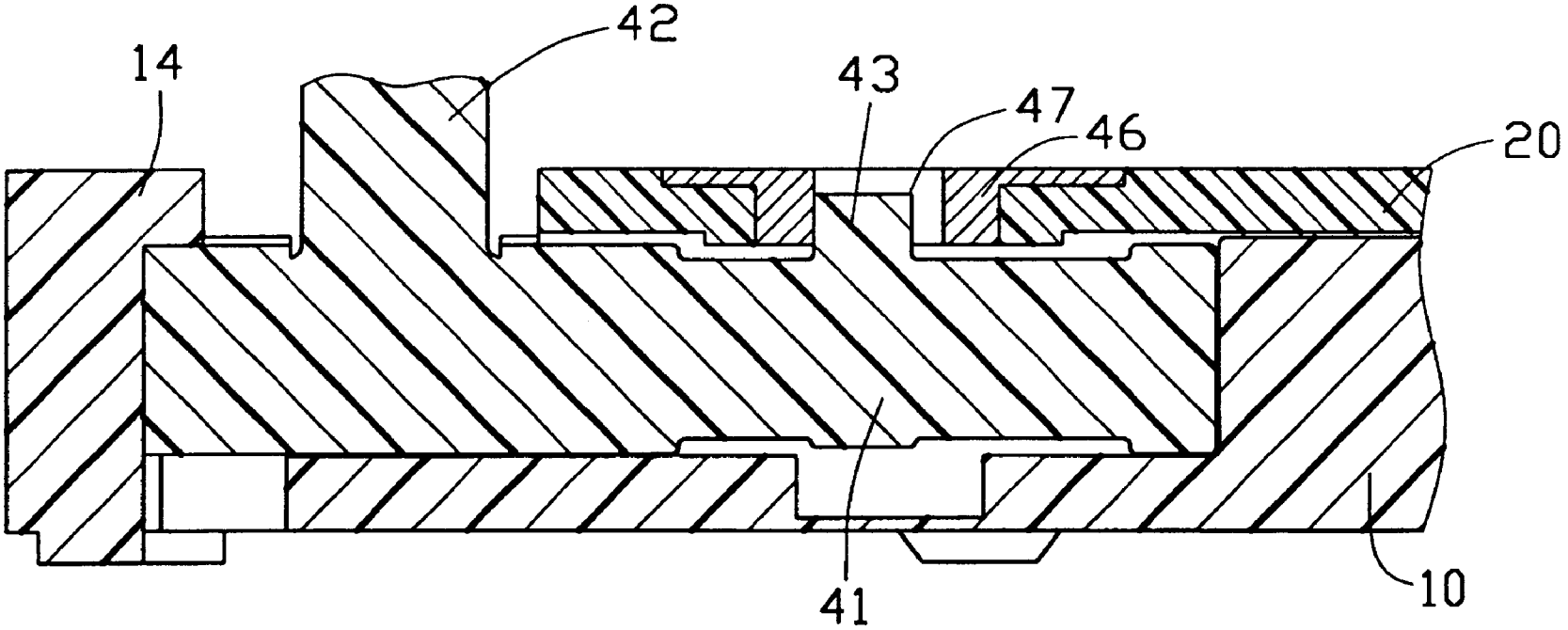
FIG. 4 is a cross sectional view of the electrical apparatus showing an upper cover member is moved toward left.
Figure 5:
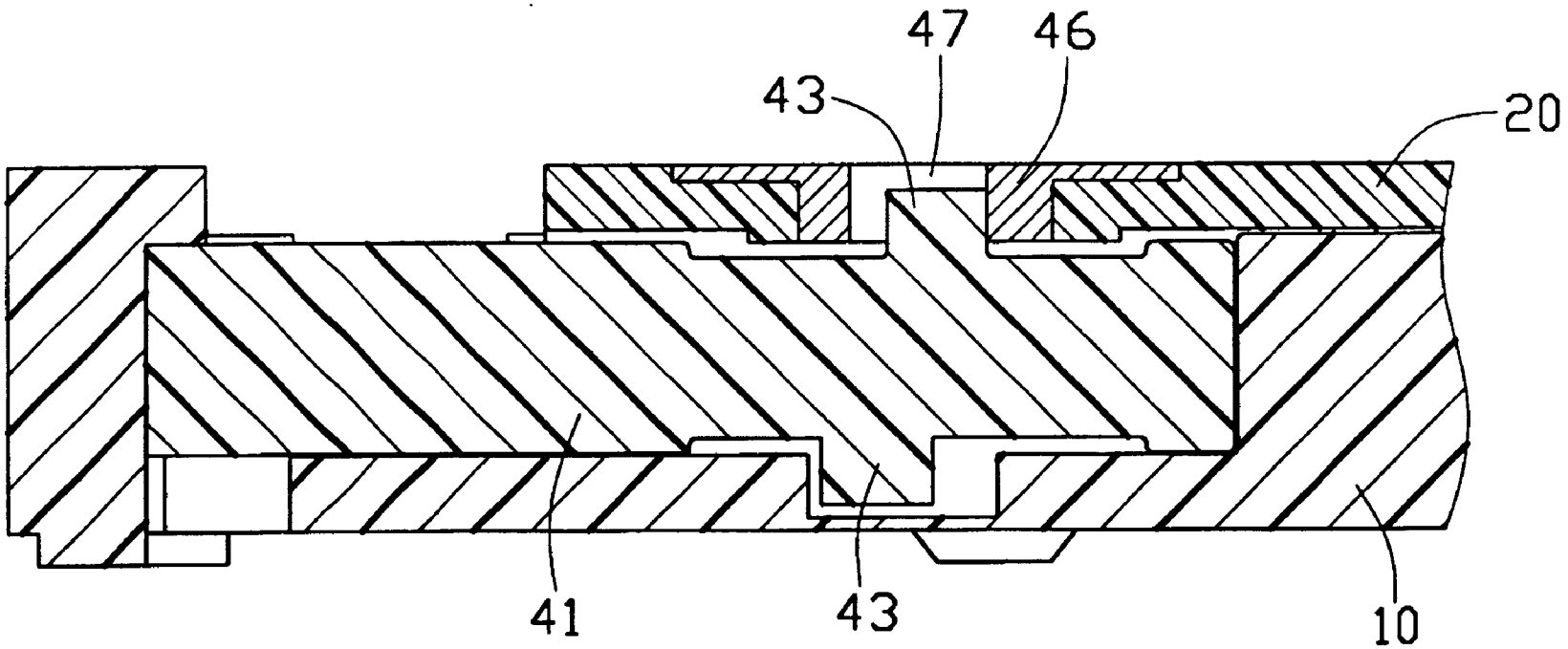
FIG. 5 is a cross sectional view of the electrical apparatus showing the upper cover is moved toward right.

Referring to FIGS. 1 through 7, an electrical apparatus 1 for electrically assembling a CPU (not shown) to a printed circuit board (not shown) in accordance with the present invention comprises a base member 10 securely assembled to the printed circuit board. The base member 10 defines a plurality terminal cell 11 therein. Each cell 11 is received with a contacting terminal 12. The terminal cell 11 has an elongate shape and the contacting terminal 12 is located at a side thereof.

Figure 7:
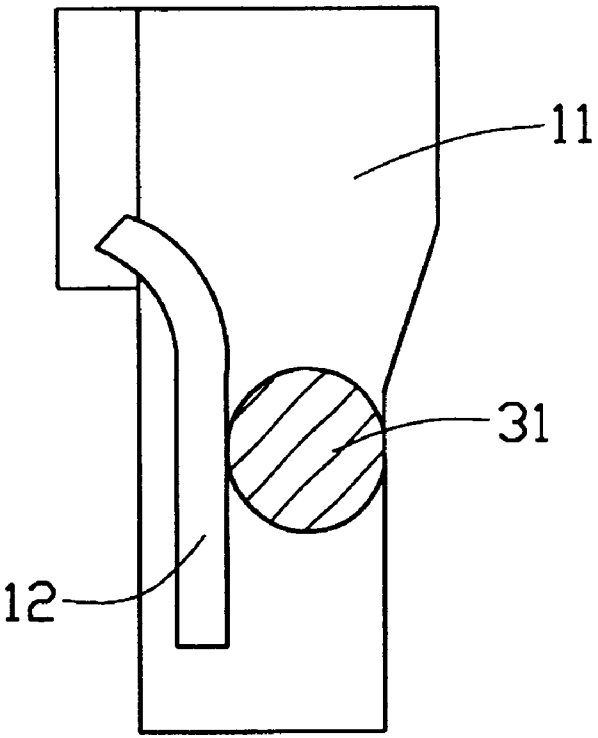
FIG. 7 is similar to FIG. 6 with the pin leg being electrically contacted with the contact terminal.
Figure 6:
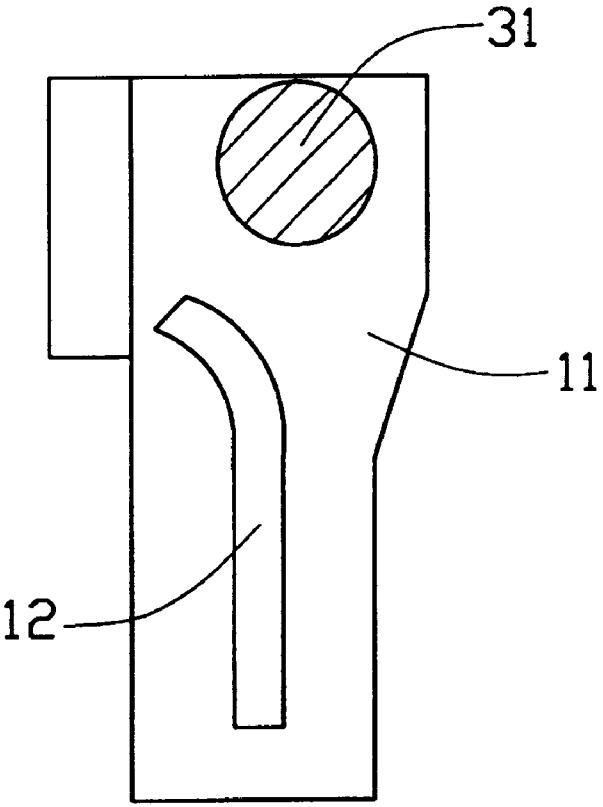
FIG. 6 is a top plan view showing a cell with a pin leg and a contacting terminal before electrical engagement therebetween.
Figure 8:
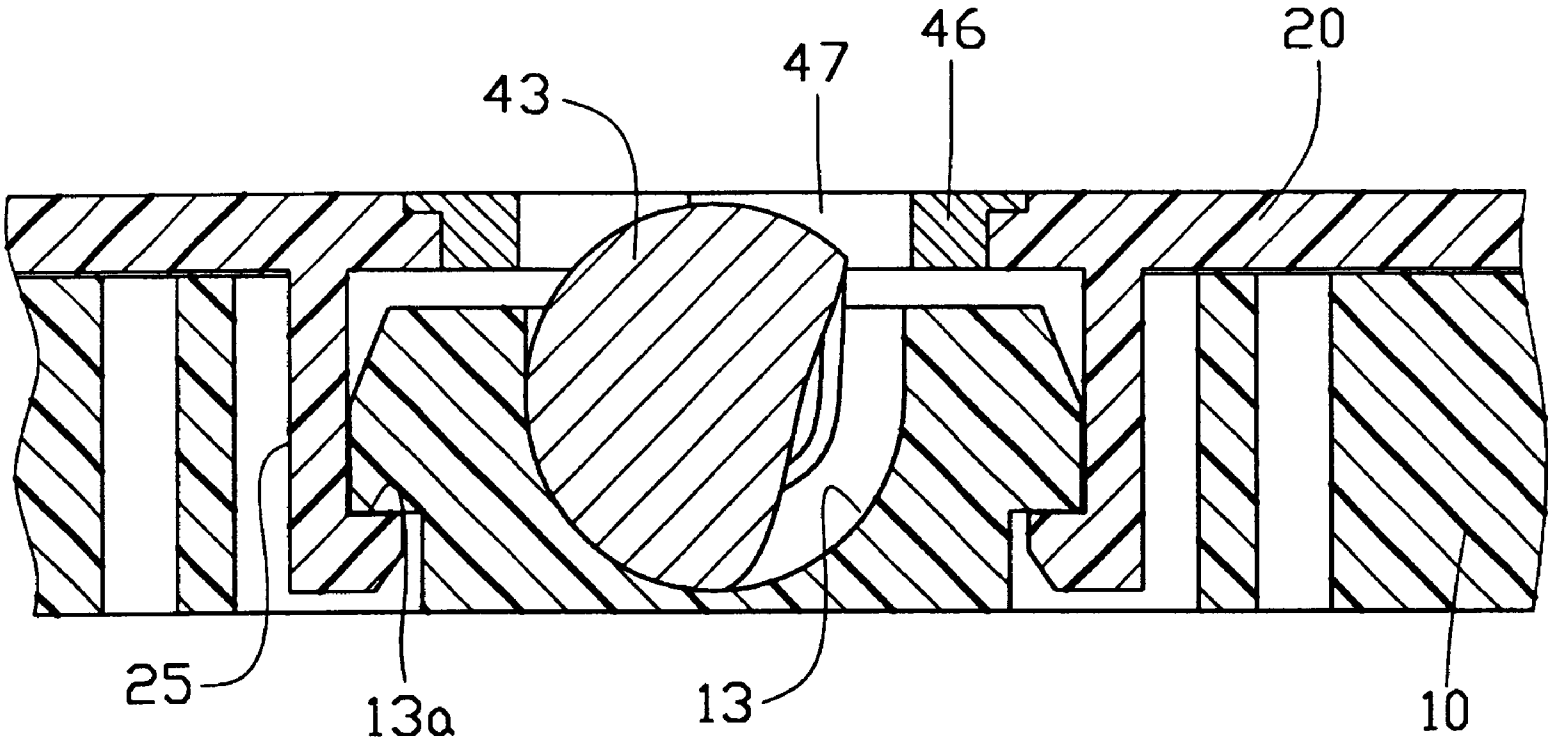
FIG. 8 is a cross sectional view taken along line VIII—VIII of FIG. 7.

A cover member 20 is moveably assembled to the base member 10 and defining an array of through holes 21 for extension of the pin legs 31 of the CPU. For the reason of simplicity, only two through holes 21 are shown. Each through hole 21 is partially aligned with the terminal cell 11. As shown in FIG. 7, the through hole 21 of the cover 20 is aligned with a lower portion 11*a* of the terminal cell 11. In this position, the pin leg 31 of the CPU can be electrically contacted with the contacting terminal 12, i.e. the through hole 21 is aligned the contacting terminal 12. However, in order to provide an easy insertion of the pin legs 31 of the CPU, the cover member 20 is moved such that the through hole 21 is shifted away from the lower portion 11*a* and to a top portion 11*b*, i.e. the through hole 21 is shifted away from the contacting terminal 12. It should be noted that the top portion 11*b* and the bottom portion 11*a* used there is just referred as easy description with respect to the drawings, it shall not be construed as a limitation thereof. Once the through hole 21 is aligned to the top portion 11*b* of the terminal cell 11, the pin leg 31 of the CPU can be easily inserted, i.e. zero insertion force. Assembly of the cover member 20 to the base member 10 can be easily achieved and as this is known and detailedly described in the prior art, no further description is given.

The present invention addresses to a mechanism to drive the cover member 20 to move between a first position in which the through hole 21 is aligned to the top portion 11*b* of the terminal cell 11, and a second position in which the through hole 11 is aligned with the bottom portion 11*a* of the terminal cell 11.

A driving arrangement 40 in accordance with the present invention is arranged between the base member 10 and cover member 20 to drive the cover member 20 to move between the first and second positions. According to the preferred embodiment, the driving mechanism 40 includes a driving shaft 41 with a lever arm 42 linked perpendicular to an end 41*a* thereof. The driving shaft 41 includes a transferring helical sector 43 extending along the shaft 41. The driving arrangement 40 further includes a follower 46 having a slot 47 capable of partially receiving a top sector 43*a* of the helical sector 43.

In order to assemble the driving arrangement 40 to the electrical apparatus 1, the base member 10 is provided with a shaft seat 13 in which the driving shaft 41 can be rotationally seated therein. The shaft seat 13 further includes an enlarged section for receiving the helical sector 43 of the driving shaft 41. The base member 10 further includes a lever rest 14 at an end thereof for positioning of the lever arm 42. The cover member 20 defines an opening 22 for positioning the follower 46 therein. The opening 22 is arranged corresponding to the shaft seat 13 of the base member 10.

In assembly, the driving shaft 13 is probably seated in the shaft rest 13 and the follower 46 is securely positioned in the opening 22 of the cover member 20. When the cover member 20 is assembled to the base member 10, the top portion of the helical sector 43 is just enveloped by the slot 47 of the follower 46.

As clearly shown in the Figures, the driving shaft 41 is probably seated in the shaft seat 13 with the axial movement being prohibited. Accordingly, when the driving shaft 41 is rotated through certain degrees by the lever arm 42, the follower 46 is moved linearly by the helical sector 43 along the axial direction of the driving shaft 41. Because the follower 46 is fixedly attached to the cover member 20, and the cover member 20 in turn is slidably assembled to the base member 10, the cover member 20 is moved linearly when the driving shaft 41 is rotated.

In the preferred embodiment, the driving shaft 41 is rotated through 180 degrees to activate the linear movement of the cover member 20 between first and second positions. However, the helical sector 43 can be arranged such that the driving shaft 41 is only need to be rotated through 90 degrees or other degrees to move the cover member 20 between first and second positions.

In addition, in order to ensure the proper engagement between the driving shaft 41 and the follower 46, the cover member 20 is provided with a pair of clips 25 fixedly engaging with a shoulder 13*a* of the shaft seat 13. Accordingly, the linear movement of the cover member 20 and the engagement between the helical sector 43 and the follower 46 can be ensured.

It is noted that the way the invention performs is very similar to that used in the table fixture(jig) where the linearly moving jig head is actuated to move in a linear direction by rotating a spiral bar, about its own axis along the same lengthwise direction, which is engaged with the inner spiral groove in said linearly moving head. Anyhow, the invention provides novel structures on the connector socket for not only allowing the socket to be practice this traditional method, but also complying with the original structures of the connector socket for the compact size and easy operation considerations.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical apparatus for electrically assembling a CPU to a printed circuit board, said CPU including an array of pin legs, comprising:

a base member securely assembled to said printed circuit board and a plurality of terminal cells defined therein, each cell being assembled with a contact terminal therein;

a cover member moveably assembled to said base member and defining an array of through holes for extension of said pin legs of said CPU, each through hole being partially aligned with said terminal cell; and a driving arrangement arranged between said base and cover member to drive said cover member to move between a first position in which said pin leg is away from said contacting terminal and a second position in which said pin leg is electrically contacted with said contacting terminal, said arrangement including a shaft having a helical section extending therealong, and a follower moveable along said helical section when said shaft is rotated;

wherein said base member defines a shaft seat for rotatably receiving said shaft therein;

wherein said shaft seat further includes an enlarged portion for receiving said helical section of said shaft;

wherein said shaft includes a lever arm attached to an end thereof for rotating said shaft;

wherein said follower includes a slot mateable with said helical section of said shaft;

wherein said base member includes an arm rest for positioning of said lever arm;

wherein said cover member includes an opening for retaining said follower therein;

wherein said cover member includes a pair of clips engaged to a shoulder of said shaft seat.

2. An electrical apparatus assembly for electrically assembling a CPU to a printed circuit board on which the apparatus is seated, said CPU including an array of pin legs, said apparatus comprising:

a base member securely assembled to said printed circuit board;

a cover member moveably assembled to said base member and defining an array of through holes for extension of said pin legs of said CPU; and a driving arrangement arranged in alignment with a moving direction of said cover member such that said cover member can be moved between first and second positions, said arrangement including a shaft having a helical section extending therealong, and a follower moveable along said helical section when said shaft is rotated;

wherein said shaft is positioned in the base member without axial movement but with rotative movement, and said follower is attached to the cover member without rotative movement but with axial movement;

wherein the follower defines a slot in compliance with an extension direction of the helical section of the shaft;

wherein the shaft is positioned in a center line of the base member;

wherein a lever arm perpendicularly extends from a distal end of the shaft, and a length of the lever arm is not larger than one half of a lateral dimension of the base member;

further including means for reinforcing securement between the base member and the cover member around the driving arrangement.

* * * * *